US005289970A

United States Patent [19]

McClure

[11] Patent Number: 5,289,970

[45] Date of Patent: Mar. 1, 1994

[54] PAPERBOARD CONTAINER HAVING REINFORCED CORNERS

[75] Inventor: Jack A. McClure, Garden City, Kans.

[73] Assignee: Inland Container Corporation, Indianapolis, Ind.

[21] Appl. No.: 955,697

[22] Filed: Oct. 2, 1992

[51] Int. Cl.[5] ..... B65D 5/66

[52] U.S. Cl. ..... 229/143; 229/149; 229/191; 229/918

[58] Field of Search ..... 229/143, 149, 153, 190, 229/191, 918, DIG. 11

[56] References Cited

U.S. PATENT DOCUMENTS

| | | | |
|---|---|---|---|
| 1,207,899 | 12/1916 | Greve . | |
| 2,041,021 | 5/1936 | Quagliotti | 229/143 |
| 2,793,801 | 5/1957 | Papadopoulos | 229/143 |
| 2,857,090 | 10/1958 | Fallert . | |
| 3,899,123 | 8/1975 | Stollberg et al. . | |
| 4,056,223 | 11/1977 | Williams . | |
| 4,129,247 | 12/1978 | McCall . | |
| 4,236,740 | 12/1980 | Sorenson et al. . | |
| 4,239,148 | 12/1980 | Sorenson et al. . | |
| 4,244,507 | 1/1981 | Garmon . | |
| 4,319,710 | 3/1982 | Osborne . | |
| 4,600,142 | 7/1986 | Quaintance | 229/143 |
| 4,621,766 | 11/1986 | McClure . | |
| 4,676,428 | 6/1987 | McClure . | |
| 4,770,339 | 9/1988 | Weimer | 229/143 |
| 4,842,189 | 6/1989 | Czosnyka | 229/143 |
| 4,913,340 | 4/1990 | Ilitch | 229/149 |
| 5,000,377 | 3/1991 | McClure | 229/154 |
| 5,002,224 | 3/1991 | Muise | 229/918 |
| 5,139,195 | 8/1992 | McClure | 229/143 |

FOREIGN PATENT DOCUMENTS

| | | | |
|---|---|---|---|
| 1194757 | 11/1959 | France | 229/918 |
| 470937 | 8/1937 | United Kingdom | 229/143 |
| 536719 | 5/1941 | United Kingdom | 229/143 |

*Primary Examiner*—Gary E. Elkins

*Attorney, Agent, or Firm*—Fitch, Even, Tabin & Flannery

[57] ABSTRACT

The corrugated container is provided with internal reinforcing panels to form corners of increased thickness, thereby augmenting the stacking strength of the container. Locking tabs are formed in either vertical endwalls or in horizontal lid panels of the container and are interlocked with the reinforcing panels being folded between overlapping reinforcing panels. Locking slots are provided in the carton sidewalls and locking flaps have ear portions engagable with edges of the locking slots, to hold the lid panels in a closed position.

11 Claims, 14 Drawing Sheets

Fig. 5
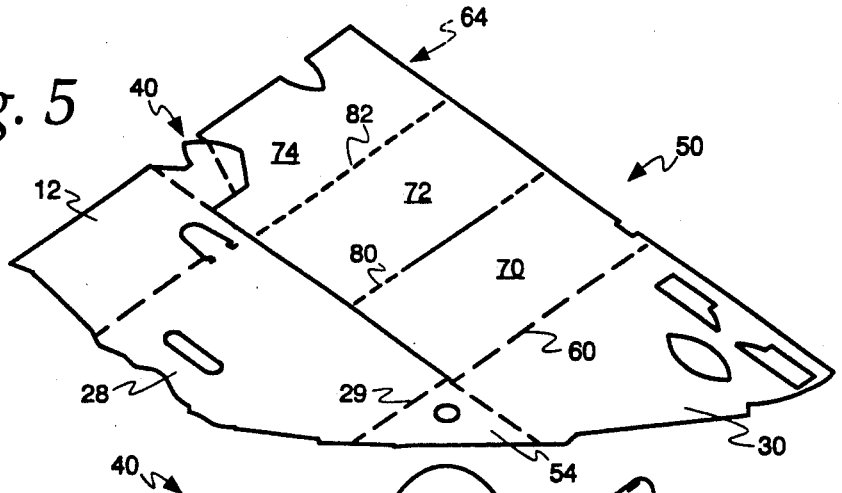
Fig. 6
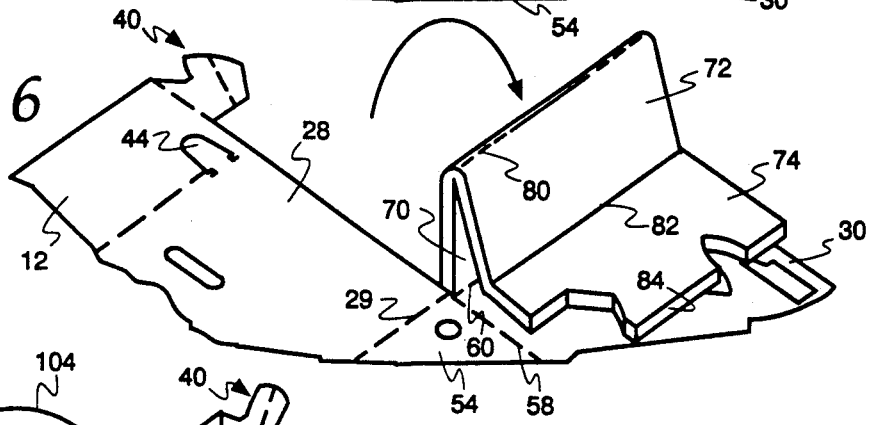
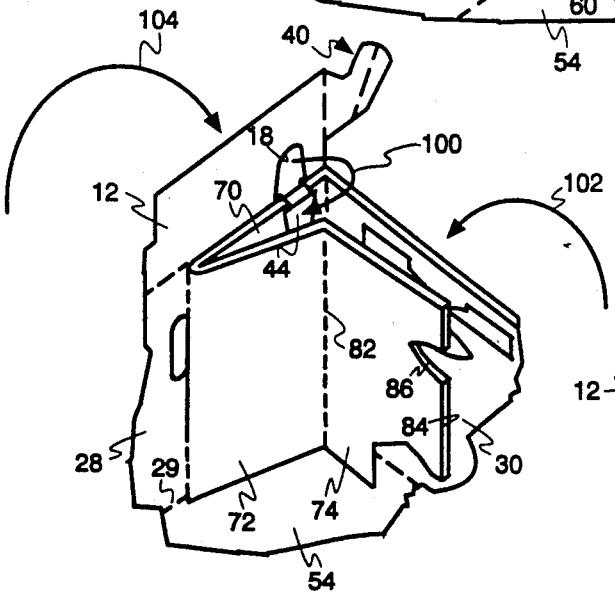
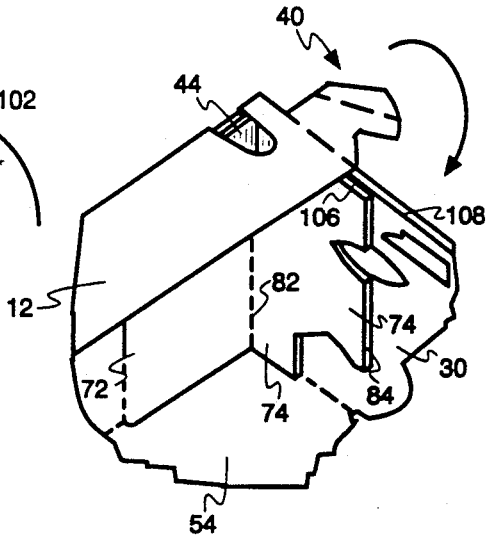
Fig. 7
Fig. 8

Fig. 15
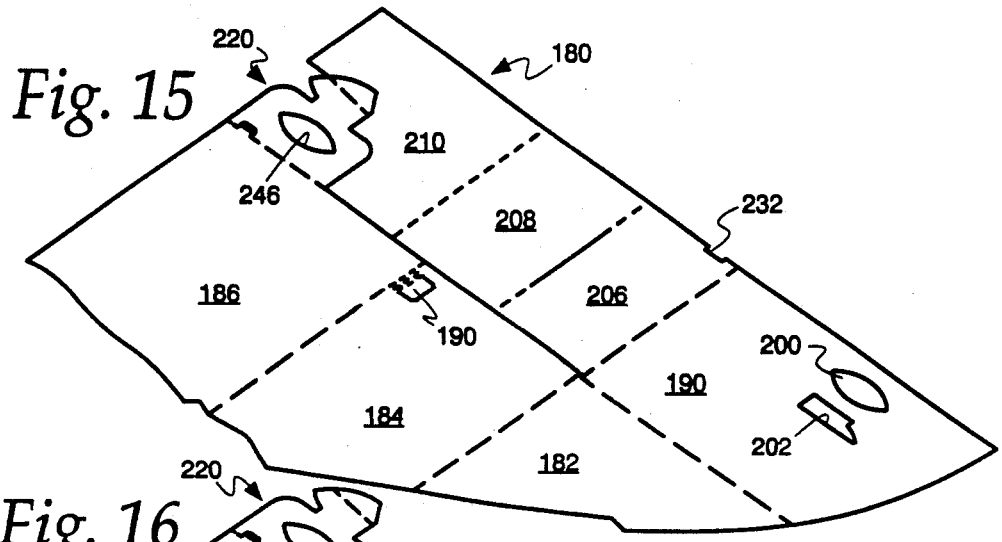
Fig. 16
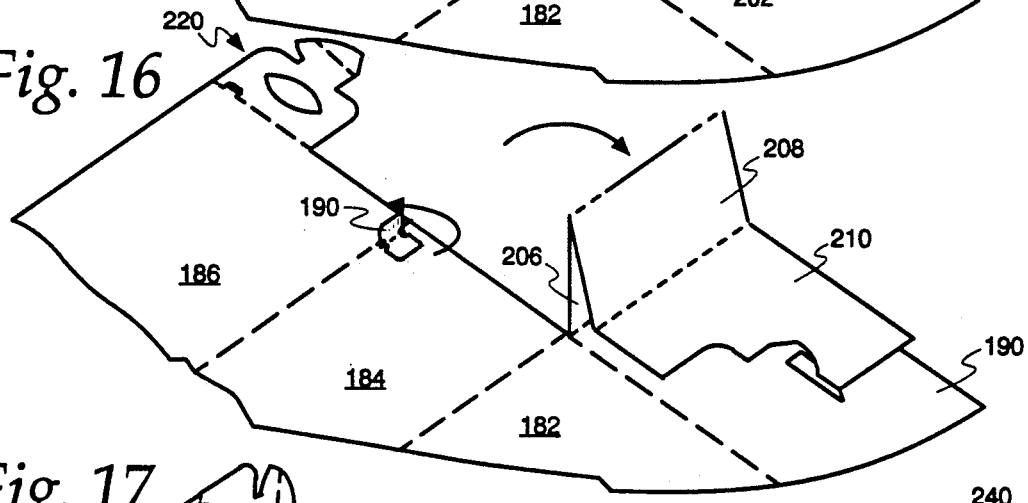
Fig. 17
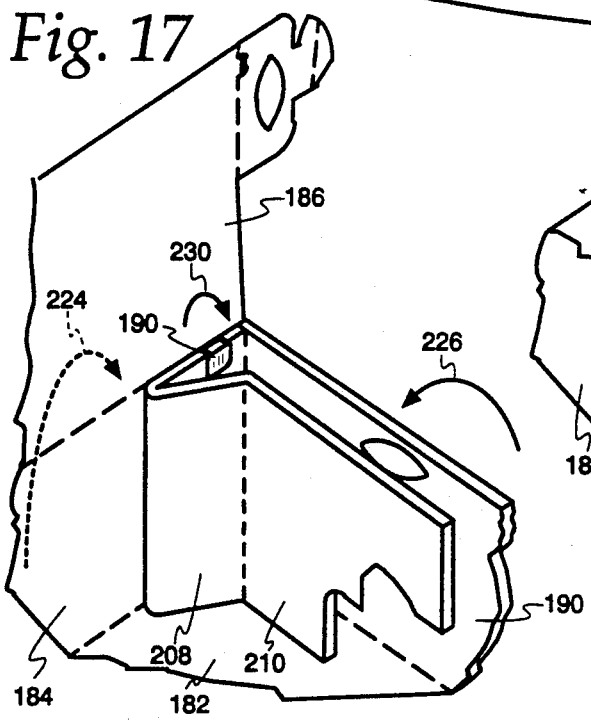
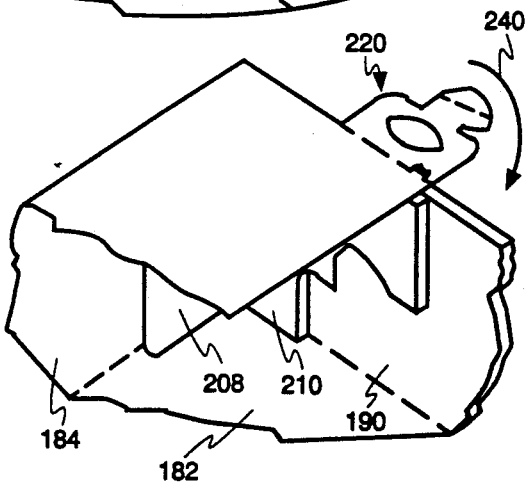
Fig. 18

PAPERBOARD CONTAINER HAVING REINFORCED CORNERS

BACKGROUND OF THE INVENTION

Field of the Invention

The present invention pertains to paperboard containers having reinforced corners, and in particular, to paperboard containers of the "hand set-up" type which are erected by manipulation of a paperboard blank.

Description of the Related Art

It is well known to have containers made from paperboard blanks, having extra layers to provide increased wall thickness at the corners of the container, to improve stacking strength. Such containers are typically used with product which is unusually heavy. Examples of such products include frozen meat cuts, and paper files. Examples of such cartons, having corner post construction and flaps limiting dust intrusion, are shown in U.S. Pat. Nos. 4,056,223; 4,239,148; 4,244,507; 4,319,710; 4,676,428; and 5,000,377. Examples of cartons having reinforced corners, which are not of the corner post type with dust-preventing lid flaps, include U.S. Pat. No. 4,236,740 used for storing paper files; U.S. Pat. No. 2,857,090; U.S. Pat. No. 1,207,899 used as a mailing wrapper; U.S. Pat. No. 4,129,247 for shipping books and U.S. Pat. No. 3,899,123 for shipping produce.

Cartons described above, such as the carton of U.S. Pat. No. 3,899,123, for example, are of the "machine set-up" type. A carton blank is formed from a requisite number of corrugated members and is blanked and folded by machine, and in some instances a machine is employed in a "gluing" operation in which carton members are secured together with a suitable adhesive. However, it is preferred in some instances to have cartons erected from paperboard blanks without using machinery or tooling. A carton blank, preferably of unitary construction, is prepared with requisite score lines, blanking and other operations to be performed on the corrugated blank. The blank is then shipped to an end user, who, with relatively simple folding and interlocking operation, forms the blank into a finished carton. Improvements in the hand set-up operations and carton blanks used with such operations have been sought.

SUMMARY OF THE INVENTION

It is an object according to principles of the present invention to provide a corrugated carton blank, offering advantages in hand set-up operation which form the blank into a finished carton.

Another object according to principles of the present invention is to provide a paperboard carton having sidewall and lid closure elements with improved locking.

These and other objects according to principles of the present invention are provided in a carton having reinforced corners of multiple thickness, formed from a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said endwall panels and said floor panel and hingedly connected to said endwall panels along hinge lines;

a pair of sidewall panels hingedly connected to the remaining pair of opposed sides of said floor panel;

a reinforcing panel subassembly coupled to each side of said sidewall panels, with pairs of reinforcing panel subassemblies overlain by a respective sidewall panel, each reinforcing panel subassembly comprising first, second and third hingedly connected reinforcing panels;

the first, second and third reinforcing panels arranged end-to-end in a series, with the first panel of each subassembly hingedly connected to a side of a respective sidewall panel, the first and second panels folded one over the other so as to overlap an endwall and so as to position the third panel to overlap a sidewall; and locking tabs extending from the endwall panels and folded between the first and second reinforcing panels to maintain the first, second and third reinforcing panels in position during assembly of the carton.

Further objects according to principles of the present invention are provided in a carton having reinforced corners of multiple thickness, formed from a one-piece blank, comprising:

a floor panel having two pairs of opposed sides;

a pair of opposed endwall panels hingedly connected to one pair of opposed sides of said floor panel, the endwall panels each having opposed sides;

lid panels in serial succession with said endwall panels and said floor panel and hingedly connected to said endwall panels along hinge lines;

a pair of sidewall panels hingedly connected to the remaining pair of opposed sides of said floor panel, the sidewall panels extending between opposed endwall panels with each sidewall panel defining at least one locking slot, said locking slot having a first end of preselected height adjacent one endwall panel and a second end of reduced height which is located adjacent the other endwall panel and which forms an acute angle portion pointing toward the other endwall panel; and locking flaps extending from at least one lid panel, having free ends forming retention ears for telescopic insertion through said locking slots and a connecting portion joining the retention ears to the lid panel, said retention ears protruding beyond said connecting portions toward the other endwall panel.

BRIEF DESCRIPTION OF THE DRAWINGS

FIGS. 5–8 are fragmentary perspective views showing the sequence of assembly of the carton blank;

FIGS. 15–18 are fragmentary perspective views showing the sequence of assembly of the paperboard blank of FIG. 14;

DETAILED DESCRIPTION OF THE PREFERRED EMBODIMENTS

Figure 1:
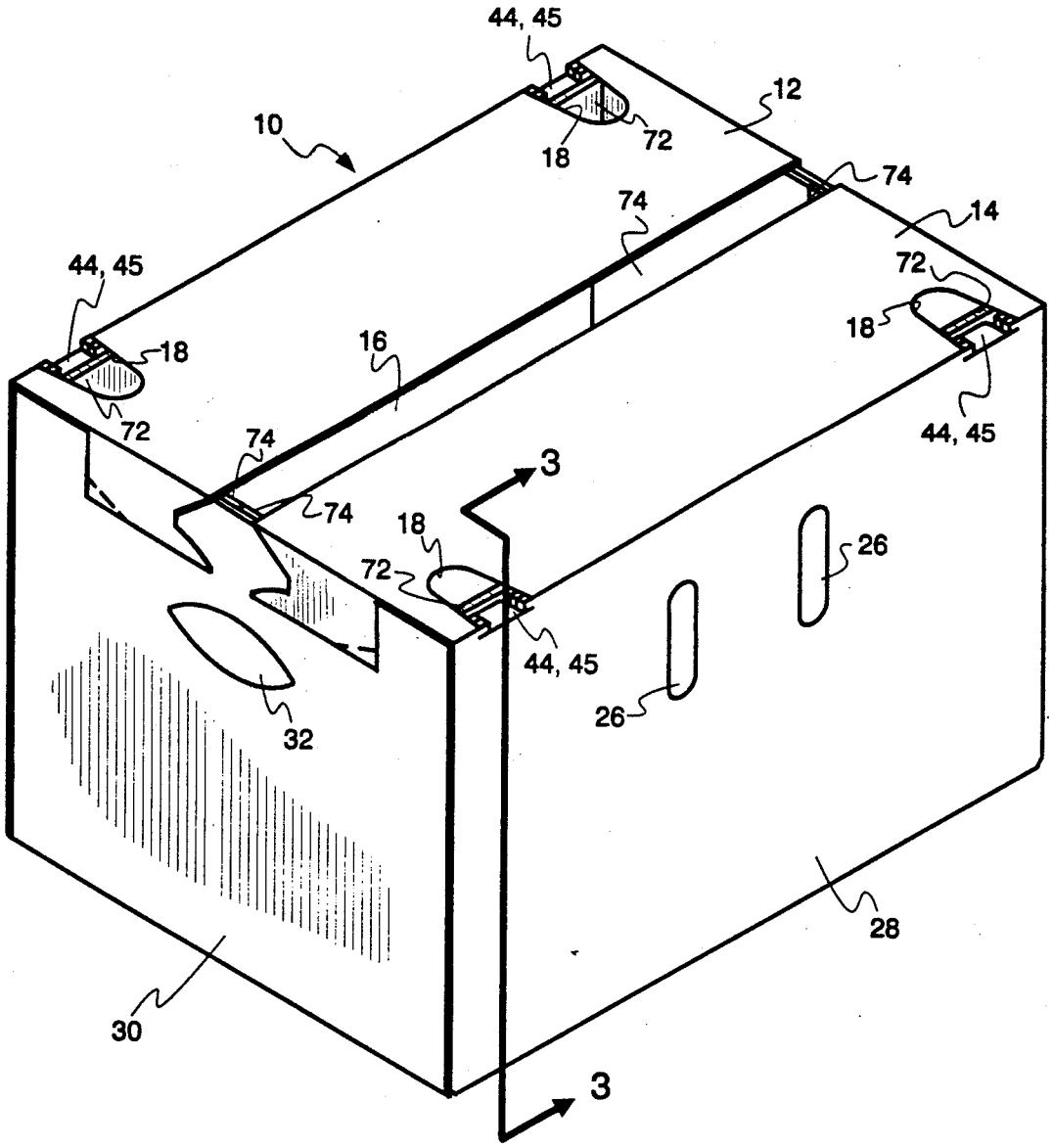
FIG. 1 is a perspective view of a carton illustrating principles according to the present invention.

Referring now to the drawings, and initially to FIGS. 1–11, a first embodiment of a carton according to principles of the present invention is generally indicated at 10. As will be seen herein, carton 10 has reinforced corners for improved stacking strength. Carton 10 has lid flaps 12, 14 spaced from one another so as to form a top opening 16 for ventilation. Additional ventilation is provided by apertures 18 formed in the top flaps, and apertures 26 formed in endwalls 28. Sidewalls 30 include hand holes 32, which incidentally provide additional ventilation.

Figure 2:
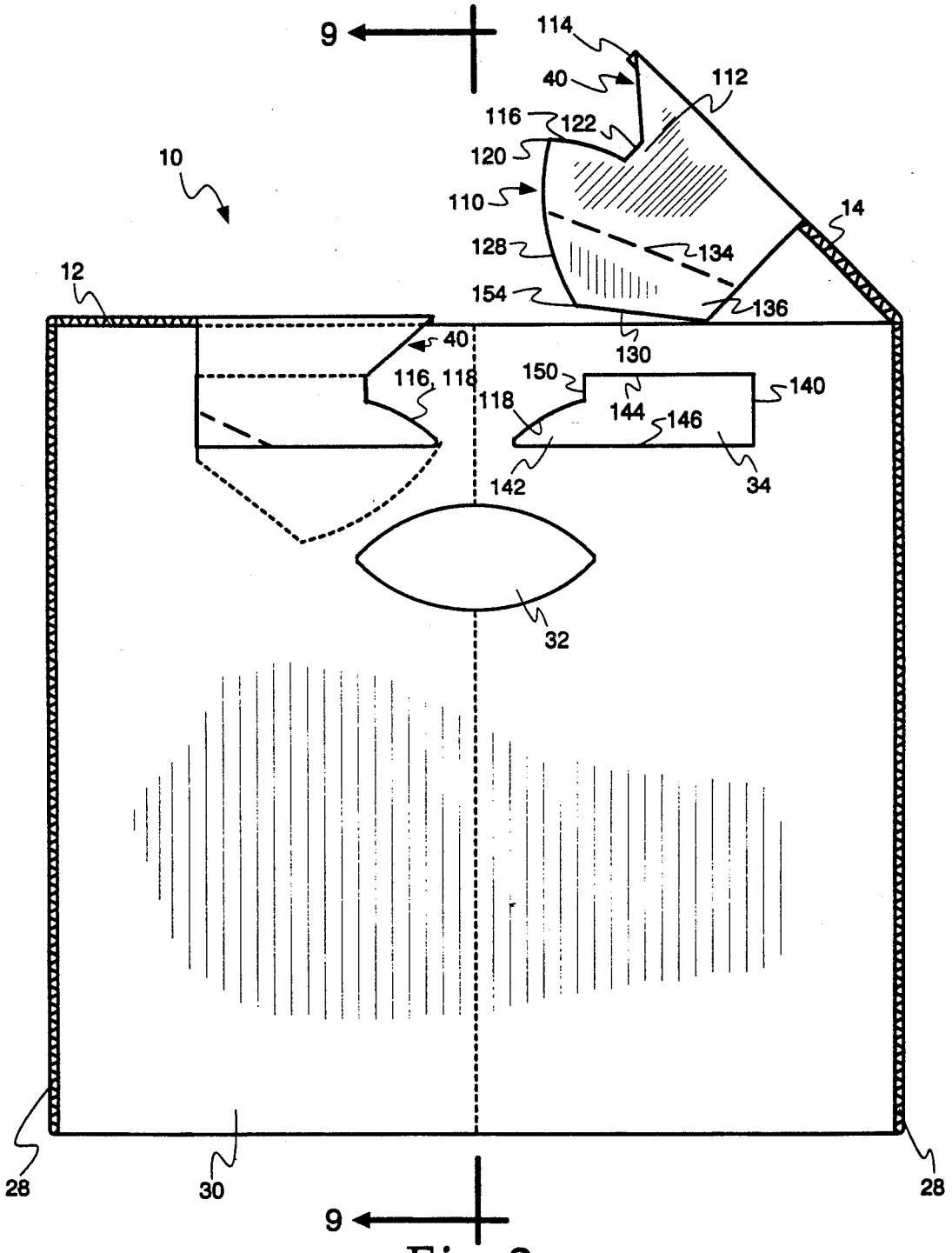
FIG. 2 is a side elevational view thereof.
Figure 3:
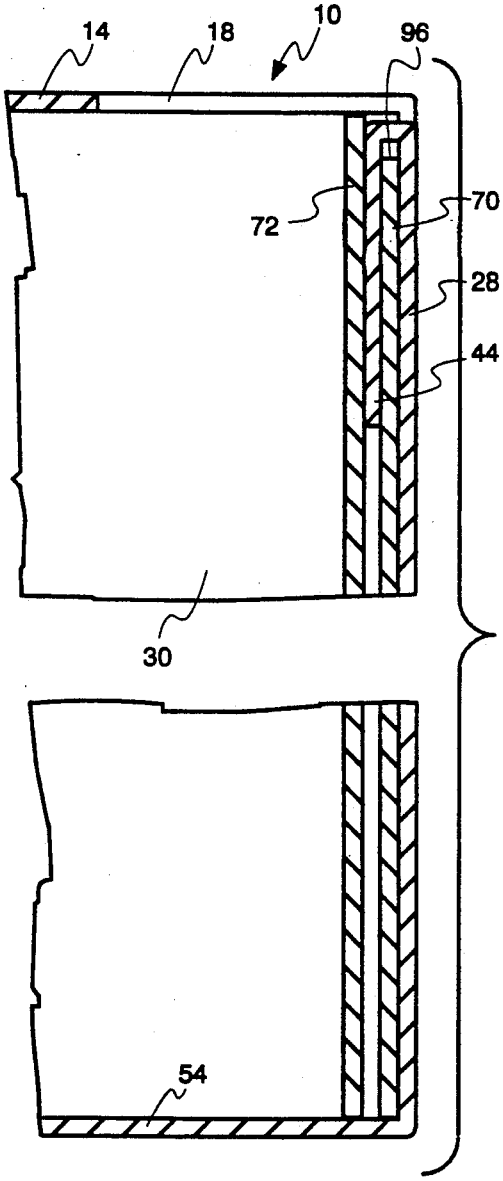
FIG. 3 is a fragmentary cross-sectional view taken along the line 3—3 of FIG. 1.

Referring now to FIG. 2, sidewall 30 has a pair of locking slots 34 having a configuration which will be described in greater detail herein. Locking flaps generally indicated at 40 are provided at each end of each lid flap and, as shown in the left-hand portion of FIG. 2, mates with the marginal edge of sidewall 30 defining the locking slots 34.

Figure 4:
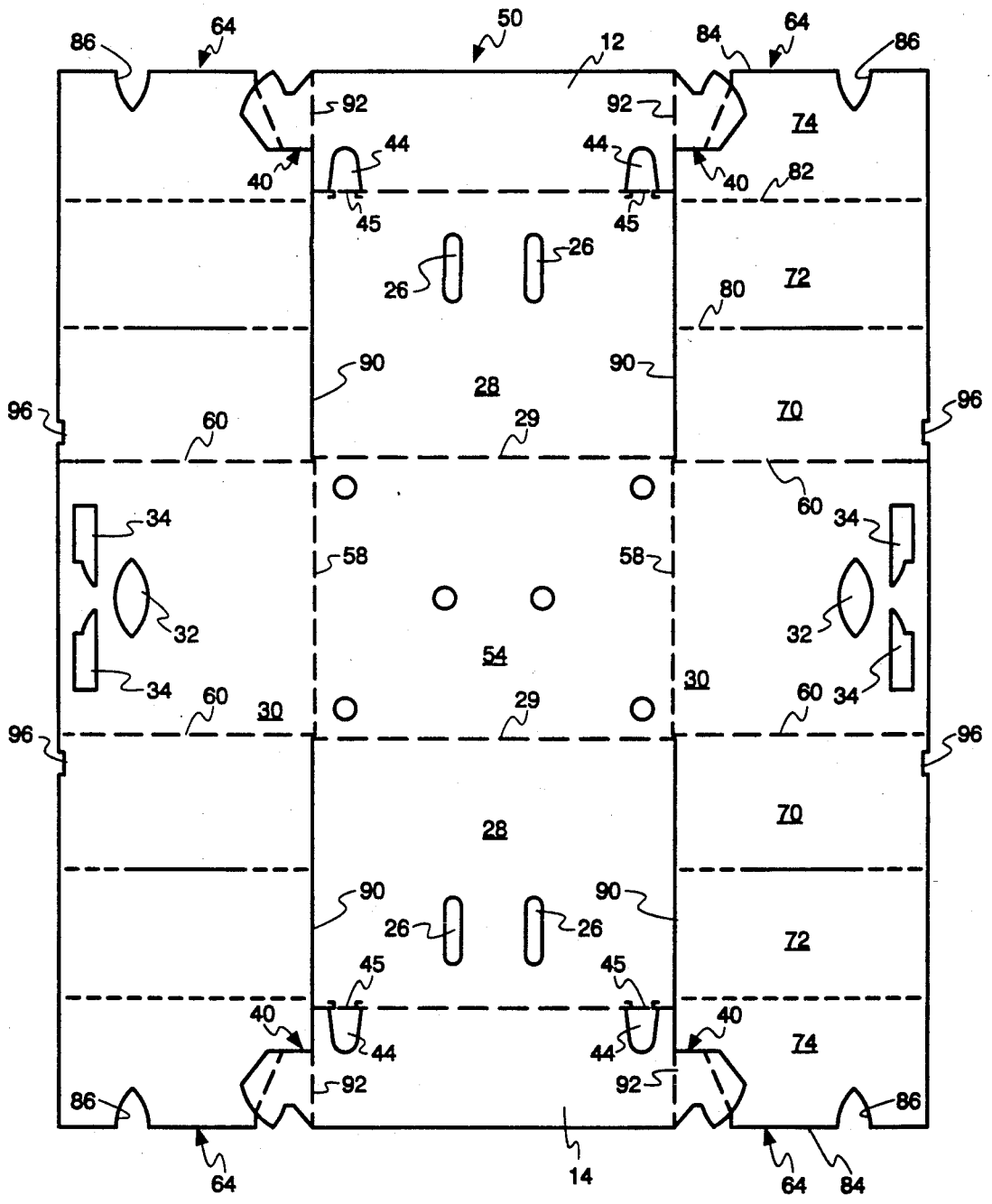
FIG. 4 is a plan view of the paperboard blank from which the carton of the preceding figures is formed.

The apertures 18 in lid flaps 12, 14 are formed by striking a locking tab 44 which is folded into the carton interior, as indicated in FIG. 1. As can be seen in the cross-sectional view of FIG. 3, locking tab 44 is held captive between overlapping walls disposed in the carton interior. Referring now to FIG. 4, carton 10 is formed from a carton blank generally indicated at 50. Carton blank 50 includes endwalls 28, sidewalls 30 and lid flaps 12, 14 mentioned above. The lid flaps and endwalls are arranged end-to-end in a series, with a floor panel 54 at the center of the series. The floor panel 54 is generally of rectangular configuration, with two pairs of opposed sides. Endwalls 28 are hingedly connected to a first pair of opposed sides, and sidewalls 30 are hingedly connected to the remaining pair of opposed sides. Sidewalls 30 are joined to floor panel 54 by hinge lines 58. Sidewall 30 has opposed lateral edges defined by hinge lines 60, one hinge line at either end of the aforementioned hinge line 58. Hinge lines 60 join reinforcing panel sub-assemblies generally indicated at 64 to each lateral edge of sidewall 30.

Each reinforcing panel sub-assembly 64 includes first, second and third reinforcing panels arranged end-to-end in a series, with the first panel attached to a lateral edge of sidewall 30 by a hinge line 60. A second panel 72 is joined to the first panel 70 by a hinge line 80 and the third panel 74 is joined to second panel 72 by a hinge line 82. The remaining end of the third panel 74 comprises a free edge 84, comprising a part of the outer perimeter of blank 50. Notches 86 are formed in free edges 84. A severing line 90 divides endwalls 28 from first and second panels 70, 72, and divides lid panels 12, 14 from the third panel 74 in a manner which forms locking flaps 40. Locking flaps 40 are joined to lid panels 12, 14 by hinge lines 92 which are colinearly formed with severing lines, and also with hinge line 58 (shown slightly offset from cut lines 90), so as to facilitate in the folding operations to be described herein.

Referring again to FIG. 4, locking tabs 44 are, for the most part, taken from lid panels 12, 14. However, a small portion of the locking tab structure, namely a strap-like connecting portion 45 visible in FIG. 1, is taken from endwalls 28. When the blank is formed, material is removed from endwalls 28 to form apertures 26, and from sidewalls 30 to form hand holes 32 and locking slots 34. Circular apertures are also formed in floor panel 54, to also provide ventilation for the carton interior.

Generally speaking, blank 50 has a rectangular configuration with straight line edges. However, portions of the blank edge are of an irregular shape to provide features which will be discussed herein. For example, notch-like recesses 96 are formed in the first panels 70 to allow the strap-like connecting portions of locking tabs 44 to be bent over the first panels. As mentioned, recesses 86 are formed in third panels 74. Irregular-shaped recesses are also formed in the free edges 84 of third panels 74 to provide a number of features for the locking flaps 40. The blank 50 is typically shipped to an end user in flat sheet form and requires only manual folding and other manipulations by an operator to erect the carton shown, for example, in FIG. 1.

Referring now to FIGS. 5–8, erection of the carton blank will now be described. A corner of the carton blank is shown in FIG. 5, and upon studying the plan view of FIG. 4, it will be seen that the carton blank has two-fold symmetry so that the corners of the blank are virtually identical to one another. Carton erection begins by folding the reinforcing panel sub-assembly 64 out of the plane of the paperboard blank, by folding at hinge line 60. Folding continues until the first panel 70 is generally at right angles to sidewall 30. Next, the second panel 72 is folded toward first panel 70, but is not pressed thereagainst at this point. The endwall 28 is thereafter folded about its hinge line 29, connecting it to floor panel 54, and is raised so as to form a right angle with the floor panel as indicated by arrow 104. A substantial gap between first panel 70 and endwall 28 is reduced or removed by pressing the panels together, and locking tab 44 is struck out of the plane of lid panel 12 and folded against the inner face of first panel 70, in the direction of arrow 100, as illustrated in FIG. 7.

The sidewall 30 is then folded about the hinge line 58 connecting it to the bottom panel 54, so as to form a right angle with the bottom panel, the folding being indicated by arrow 102 in FIG. 7. At this point, the second and third end panels are slightly spaced from first panel 70 and sidewall 30, respectively.

Endwall 28 is then folded about fold line 29, as indicated by arrow 104. The folding of the reinforcing panels 70–74 separates the locking flap 40 from the reinforcing panel sub-assembly and completes formation of the locking flap in preparation for a subsequent step.

The second panel 72 is then pressed against first panel 70, "sandwiching" or compressing the locking tab 44 between the panels. The reinforcing panels are dimensioned so that this pressing brings the third panel 74 against sidewall 30. The bottom edge of third panel 74 is brought in contact with floor panel 54, or is spaced very closely thereto, and the upper edge 106 is generally aligned with the upper edge 108 of sidewall 30 so as to prevent rotation of third panel 74 in a direction opposite to that of arrow 104 shown in FIG. 7, when the lid flap of the carton is closed and locked in position, as shown for example in the left-hand portion of FIG. 2.

Referring now to FIG. 2, the lid panels 12, 14 each carry locking flaps 40 which mate in locking slots 34. The locking flaps 40 include a locking ear generally indicated at 110 which is joined to lid 14 with a connecting portion 112, which is preferably set back from the free edge 114 of lid 14. In the preferred embodiment the setback is filled with a triangular flap portion, as can be seen in FIG. 2. The locking ear 110 includes a number of portions which will now be described. These portions are not necessarily distinguished by visible surface features, but are identified in the various ways they cooperate to assist in locking the lid flaps in closed position. For example, the locking ear 110 includes a lock portion which protrudes beyond the connecting portion 112 and which has a locking edge 116 as a visible structural feature. This locking edge 116 mates with a concave locking edge 118 defining one end of locking slot 34. The lock portion of ear 110, as referred to here, may be generally regarded as that portion of locking ear 110 bounded by locking edge 116, a line parallel to lid 14 extending from pointed tip 120 and a line extending from and parallel to the edge 122 of connecting portion 112. The bottom or "retention" portion of locking ear 110 (that portion extending below the aforementioned line which is parallel to lid 14 and extends from pointed tip 120) serves generally to guide the locking ear through slot 34 and between overlapping walls of carton 10 and also serves to retain the locking flap 40 in engagement with the locking and retaining features of the carton sidewalls and overlying retention flaps, as will be explained herein.

As shown in FIG. 1, the third reinforcing flaps are dimensioned so as to butt against one another with their opposed edges 84 in engagement, when the carton is fully erected. This butting action of the third flaps, in combination with the folds and configuration of the retention flap sub-assembly and the locking tabs 44, provides a stable self-supporting carton construction, one resisting inward collapse of the retention sub-assemblies. Accordingly, an operator need not be distracted while filling the carton, to maintain the hand set-up carton in an open, erected position.

Referring again to FIG. 2, the bottom, retention portion of locking ear 110 has a convex edge which includes edge portions 128, 130. The edge portions 128, 130 meet at a point 154. The retention portion of locking ear 110 is divided by a fold or score line 134 lying at an angle, i.e., is non-parallel, to either edges 128, 130 or the major surface of lid 14. The fold line 134 allows the bottom portion 136 of the retention part of locking ear 110 to be inwardly folded for entry into the locking slot which will now be described with additional reference to FIGS. 9 and 10.

As can be seen in FIG. 2, the locking slot 34 has opposed ends, including a first end 140 of greater height and a second end 142 of lesser height. The first end 140 corresponds to one edge portion of the locking slot, preferably extending in a generally vertical direction. Edge portions 144, 146 are preferably generally parallel to one another and extend in a generally horizontal direction. According to one aspect of the present invention, the lower edge 146 is preferably longer than the opposing upper edge 144, so that the second end 142 forming an acute angle protrudes beyond the edge portion 150. Essentially, the end 142 located adjacent the center line of sidewall 30 has a reduced height, so as to provide a wedging or pinching action which locks flap 40 in the position illustrated in the left-hand portion of FIG. 2. The second end 142 is preferably defined by the inner section of edges 146, 118.

Figure 10:
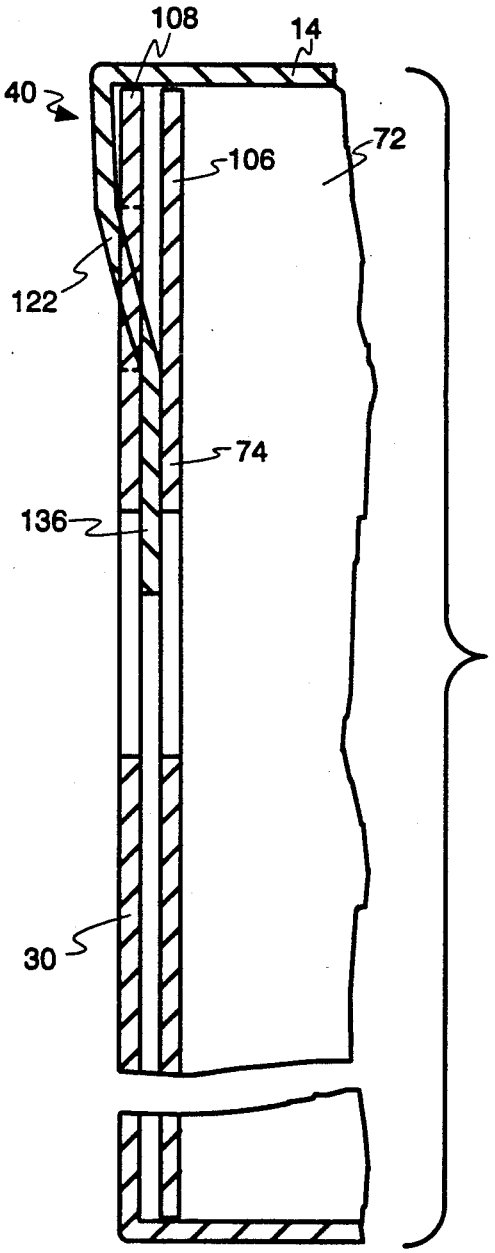
FIGS. 9 and 10 are fragmentary cross-sectional views taken along the line 9—9 of FIG. 2.
Figure 9:
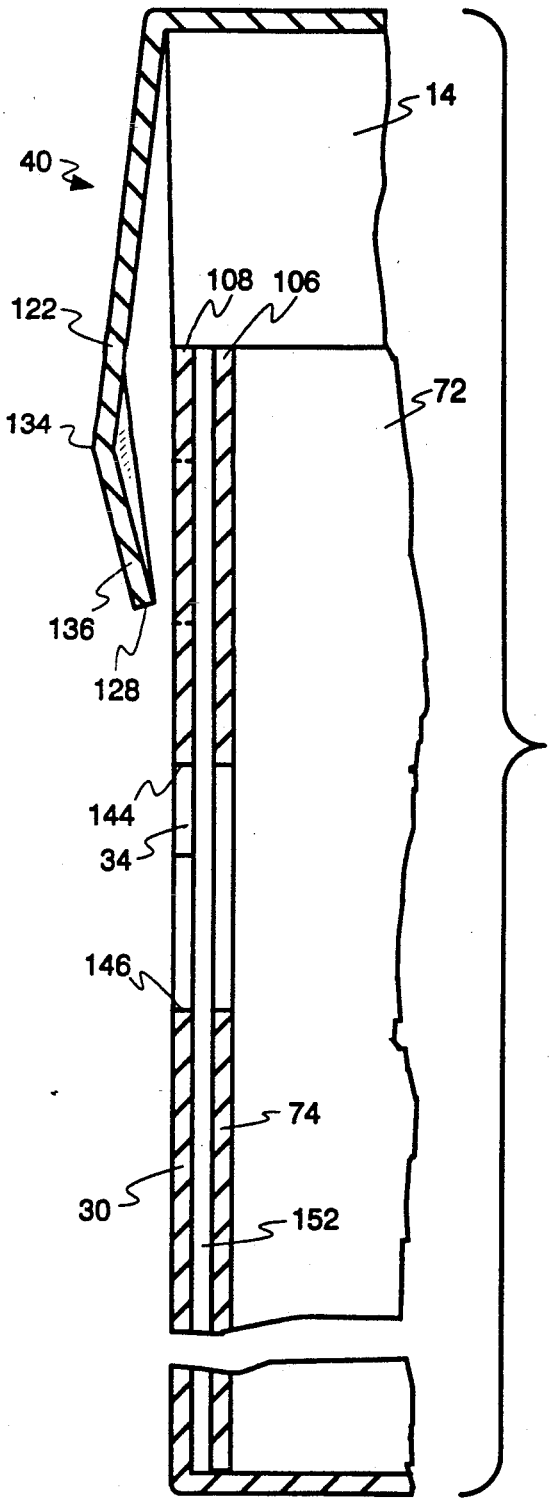

With additional reference to FIGS. 9 and 10, it will be appreciated that the locking flap 40 is inserted in a relatively small gap between sidewall 30 and reinforcing wall panel 74. Carton 10 is designed so that locking flap 40 can be inserted in locking slot 34 with little or no intrusion of reinforcing panels into the carton interior, with the relatively small gap 152 between the sidewall panel 30 and third reinforcing panels 74 being maintained. As shown in FIG. 10, for example, the gap 152 is preferably on the order of one, or at most, a few thicknesses of locking flap 40.

Figure 11:
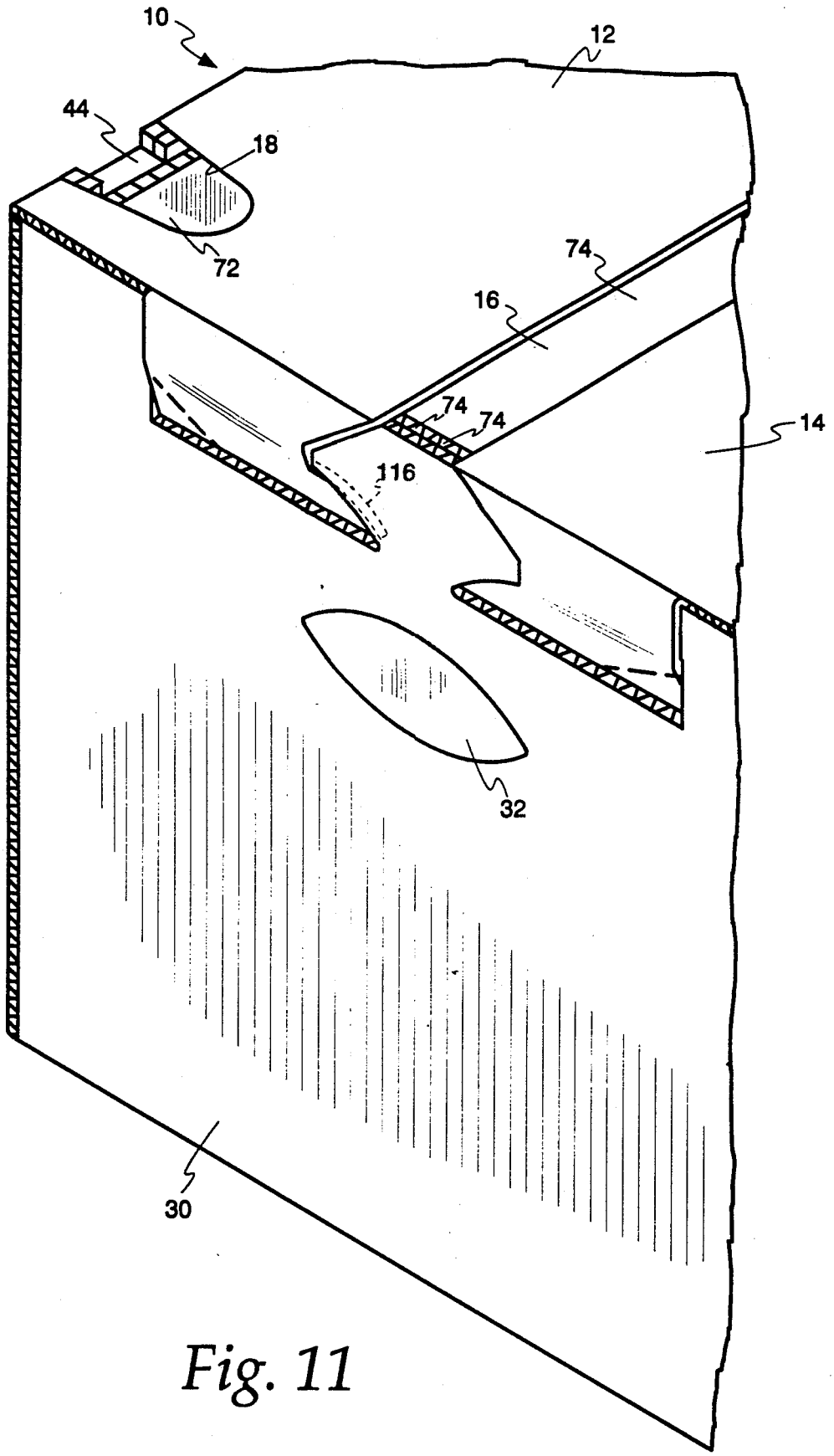
FIG. 11 is a fragmentary perspective view thereof.
Figure 12:
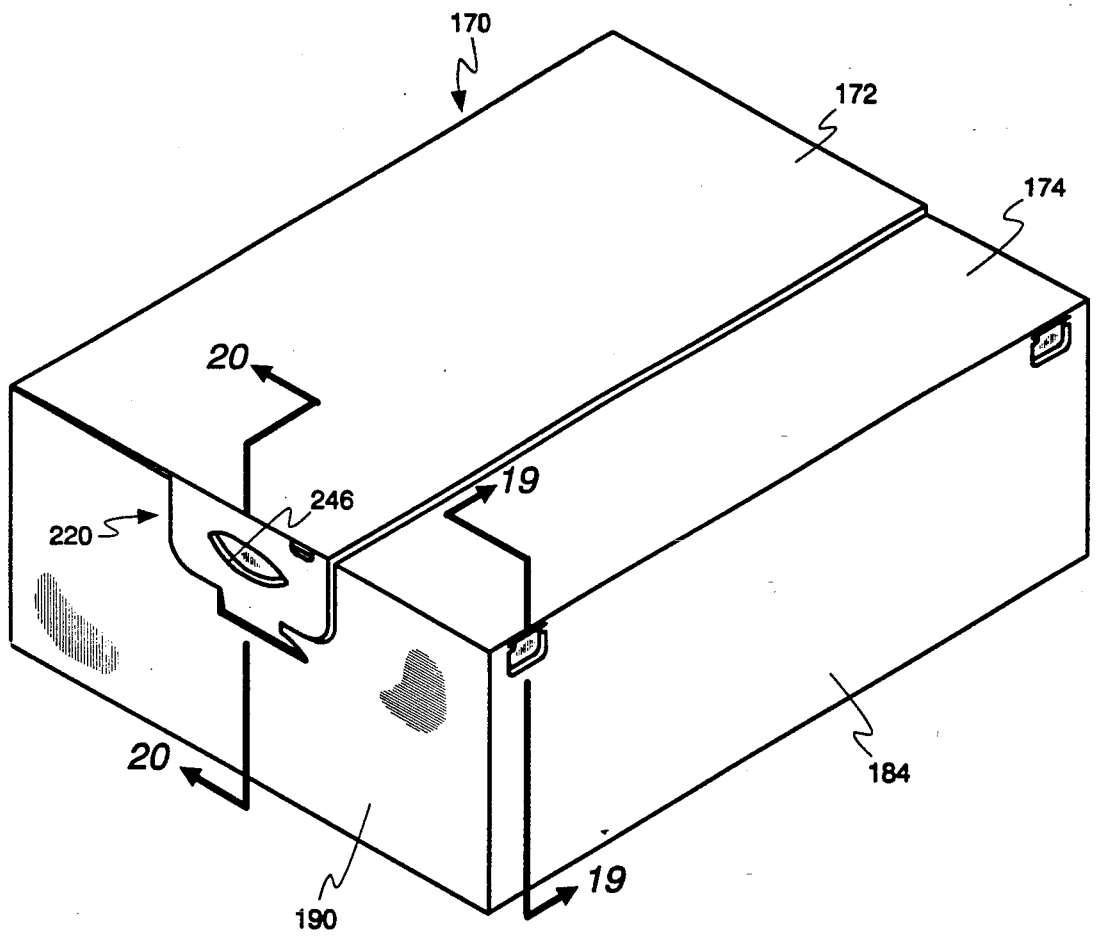
FIG. 12 is a perspective view of another carton according to principles of the present invention.
Figure 13:
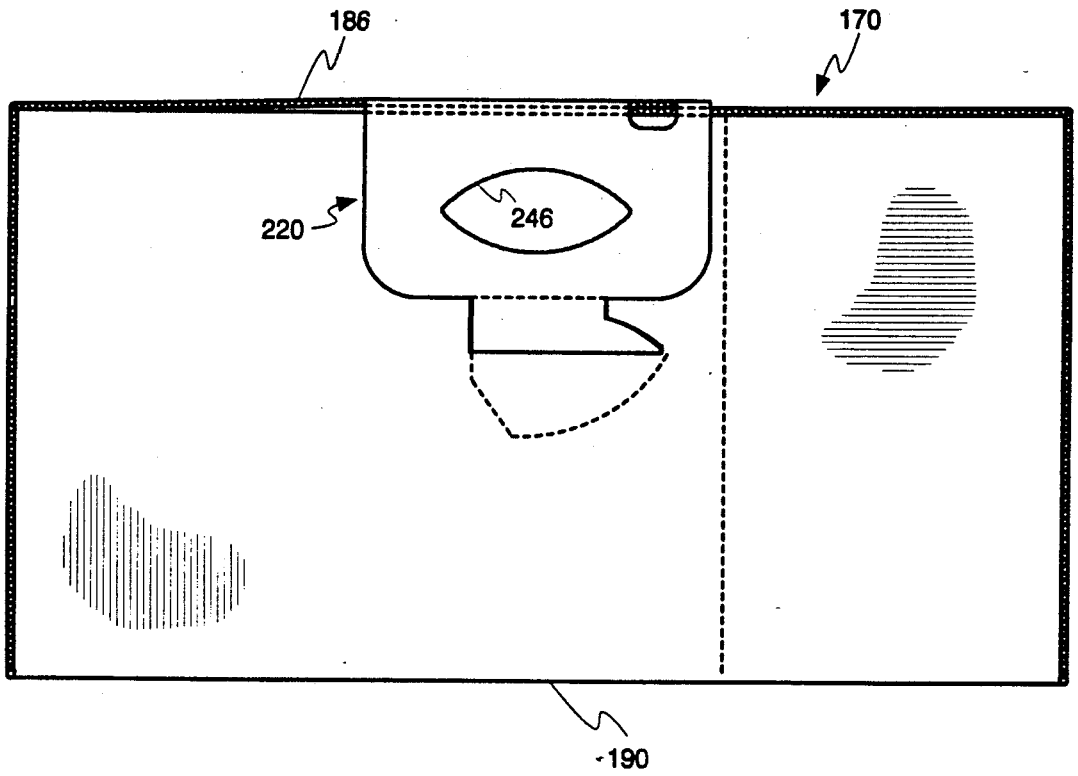
FIG. 13 is an elevational side view of the carton of FIG. 12.
Figure 14:
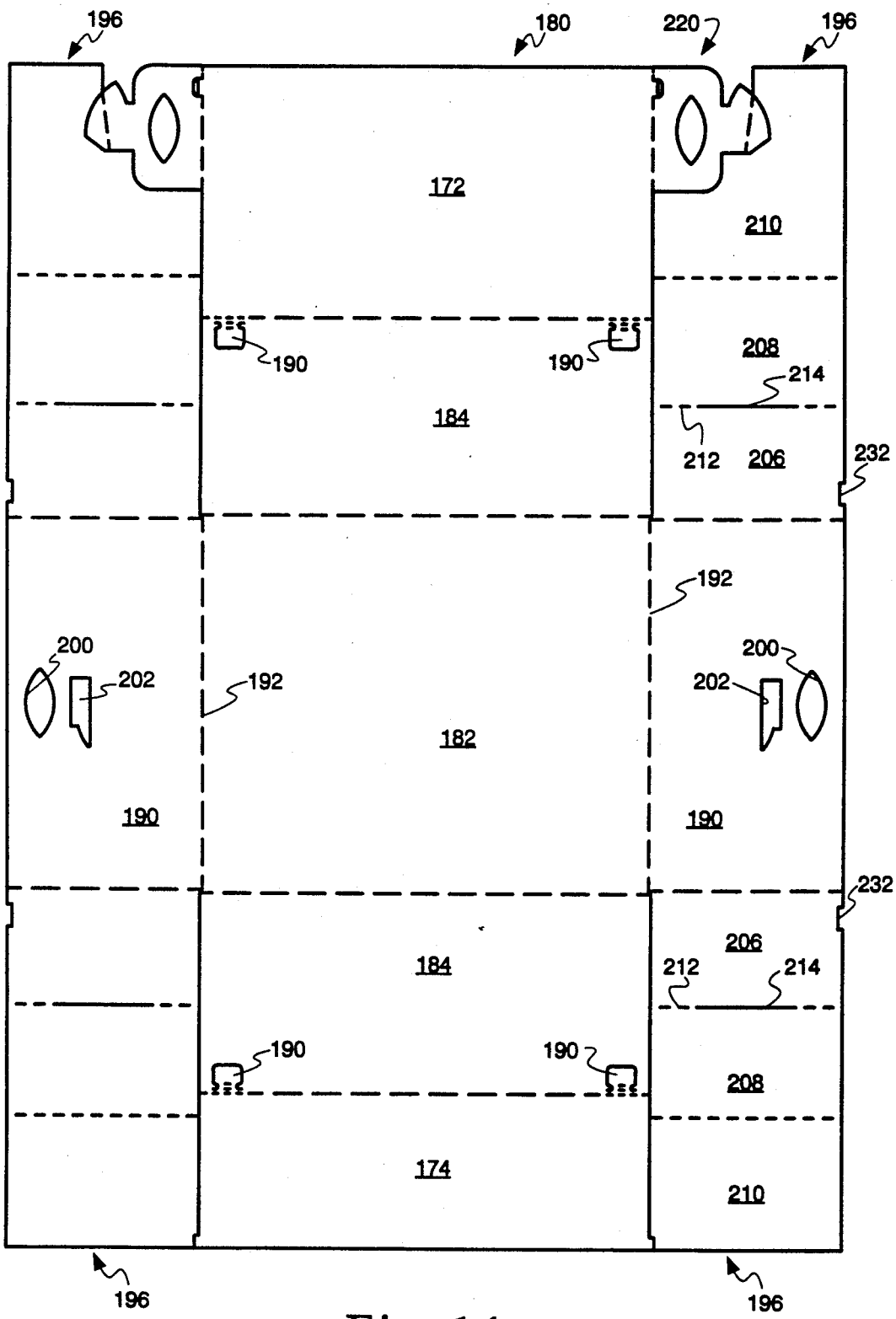
FIG. 14 is a top plan view of the paperboard blank from which the carton of FIG. 12 is erected.

Upon insertion of locking flap 40 in slot 34, the pointed corner 154 of the lower retention portion 136 enters slot 34 as the initial point of entry. If the locking flap is not already aligned for entry at the lower portion of slot 34, the locking flap will cam across that portion of sidewall 30 adjacent locking edge 118 and be guided toward the lower edge 146. With continued insertion of locking flap 40, the width of the flap entering slot 34 increases, and accordingly, edge 128 has a convex curved configuration to assist in the camming engagement during locking flap insertion. The bottom portion 136 of the locking flap is initially inwardly curved as it approaches the gap 152, and is thereafter aligned parallel to sidewall 30 and reinforcing panel 74 as it enters gap 152. As indicated in FIG. 10, the connecting portion 122 bends along a fold portion extending generally parallel to lid flap 14 so as to provide the necessary lateral offset. As can be seen in FIGS. 10 and 11, the locking portion of flap 40, including the locking edge 116, is "toed in" or bent away from a vertical plane, toward the carton interior, so as to increase engagement between the locking edges 116, 118.

According to one aspect of the present invention, the locking tabs 44 maintain engagement between end panels 28 and the reinforcing panel sub-assembly. Outward forces tending to "bow out" the end walls therefore exert a torque on the third reinforcing panel of the sub-assembly, causing an upward force on the mating edge 84 of the third reinforcing panel. This force is resolved by the lid panel and the locking flap 40 in a way which takes the maximum advantage of the geometry-related strength of the assembled locking flap.

Referring now to FIGS. 12–21, a second embodiment of a carton according to principles of the present invention is generally illustrated at 170. Whereas carton 10 described above had two locking flaps for each sidewall, carton 170 has a single locking flap. The lid flaps 172, 174 of carton 170 overlap one another, whereas the lid flaps of carton 10 are spaced from one another. As will be seen herein, other aspects of the cartons 10, 170 are similar. The carton blank 180, shown in FIG. 14, includes a bottom wall 182 arranged in a series with endwalls 184 and lid flaps 172, 174. Locking tabs 190 are struck out of endwalls 184, whereas in carton 10 the locking tabs were struck from the lid panels. Sidewalls 190 are joined to floor panel 182 by hinge lines 192 and a reinforcing panel sub-assembly 196 extends from each lateral edge of each sidewall. Hand holes 200 and a single locking slot 202 are formed in each sidewall.

The reinforcing panel sub-assemblies 196 include a series of hingedly connected first, second and third panels 206, 208 and 210, respectively. As with the preceding embodiment, the hinge lines 212 joining first and second panels 206, 208 are interrupted by a central cut portion 214.

Figure 20:
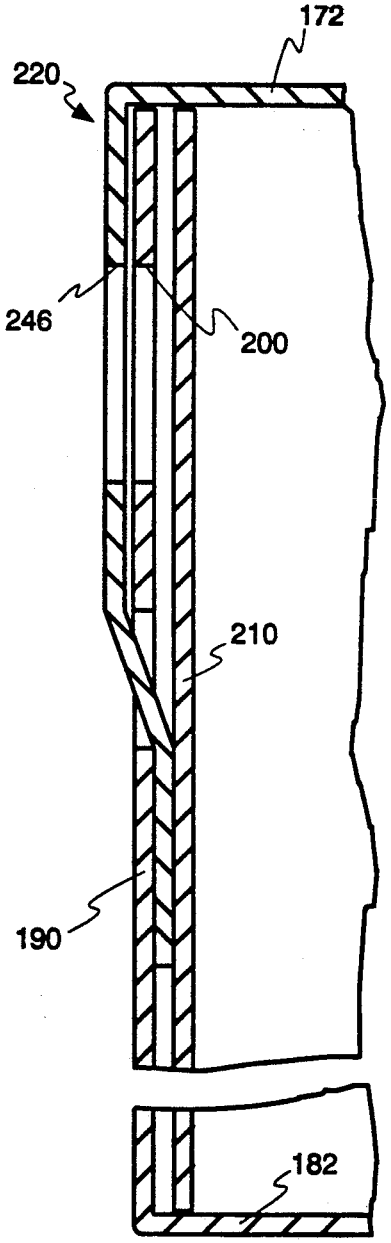
FIG. 20 is a fragmentary cross-sectional view taken along the line 20—20 of FIG. 12.
Figure 21:
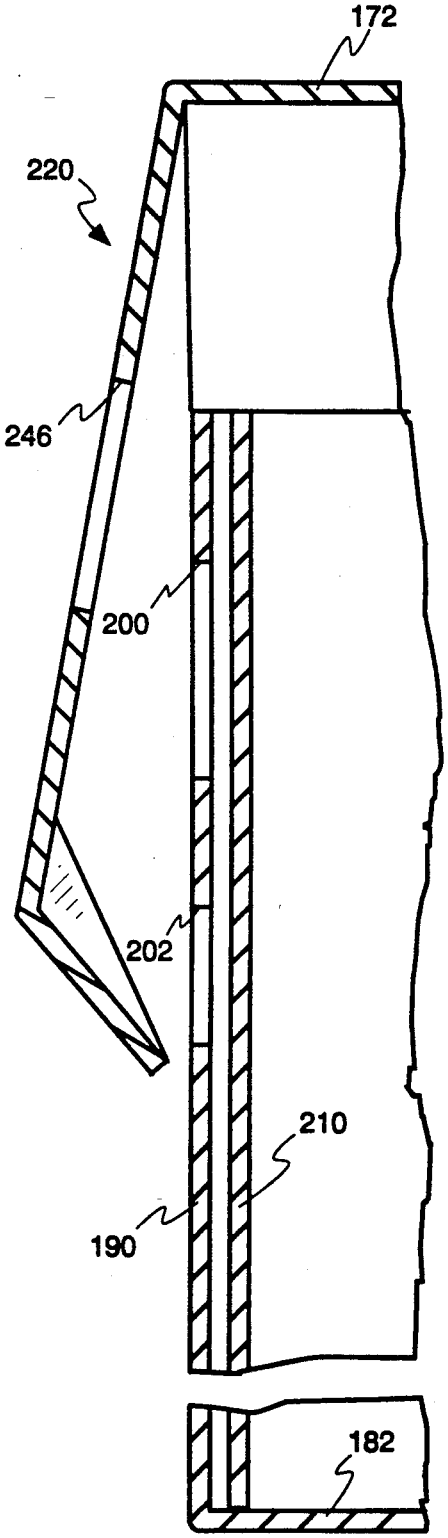
FIG. 21 is a view similar to that of FIG. 20, but showing the lid flap in an open position.

Referring to FIGS. 15–18, assembly of the carton blank follows in the manner similar to that described above for carton 10. As can be seen from studying FIG. 14, the blank 180 is symmetrical about a longitudinal center line, but is not symmetrical about a transverse center line, e.g., the locking flaps are located at only the upper end in FIG. 14 and the locking slot 202 has a reduced height (acute angle) end facing away from the locking flaps. The first reinforcing panel 206 is raised to a generally right angle with respect to sidewall 190 as shown in FIG. 16. This folding operation separates the locking flaps 220 from the reinforcing panel sub-assemblies 180. The locking tabs 190 are then lifted out of the plane of endwalls 184 in preparation for lifting the endwalls in the direction of arrow 224 of FIG. 17. The sidewalls 190 are raised in the direction of arrow 226 to also form a right angle with floor panel 182. The locking tabs 190 are then folded over in the direction of arrow 230, so as to be received in recesses 232 formed in the first reinforcing panels 206, the second and third reinforcing panels 208, 210 against the first reinforcing panel and sidewall 190, respectively, as shown in FIG. 18. The locking flaps 220 are thereafter folded through the locking slots 202, as indicated by arrow 240 in FIG. 18. In the fully locked position shown in FIG. 20, the lower end of locking flap 220 is inserted between sidewall 190 and third reinforcing panel 210. Configuration of the locking ear portion of the locking flap and of the locking slot 202 are the same as described above for carton 10. One difference to be noted is the provision of a hand hole 246 to be aligned in registry with the hand hole 200 when the locking flap is fully inserted, as illustrated in FIG. 20.

Figure 19:
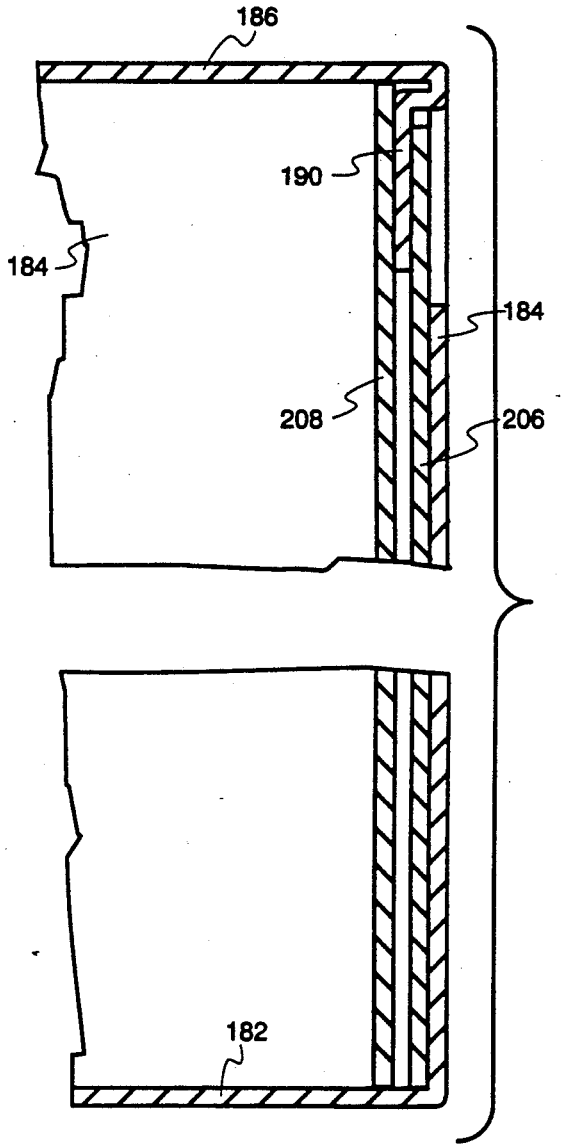
FIG. 19 is a fragmentary cross-sectional view taken along the line 19—19 of FIG. 12.

Referring now to FIG. 19, the locking tab 190 is initially folded in an upward direction, generally horizontal so as to provide clearance for the first reinforcing panel folded against endwall 184. The locking tab 190 is thereafter folded in a downward direction against reinforcing panel 206 so as to be held against the reinforcing panel by panel 208.

Figure 22:
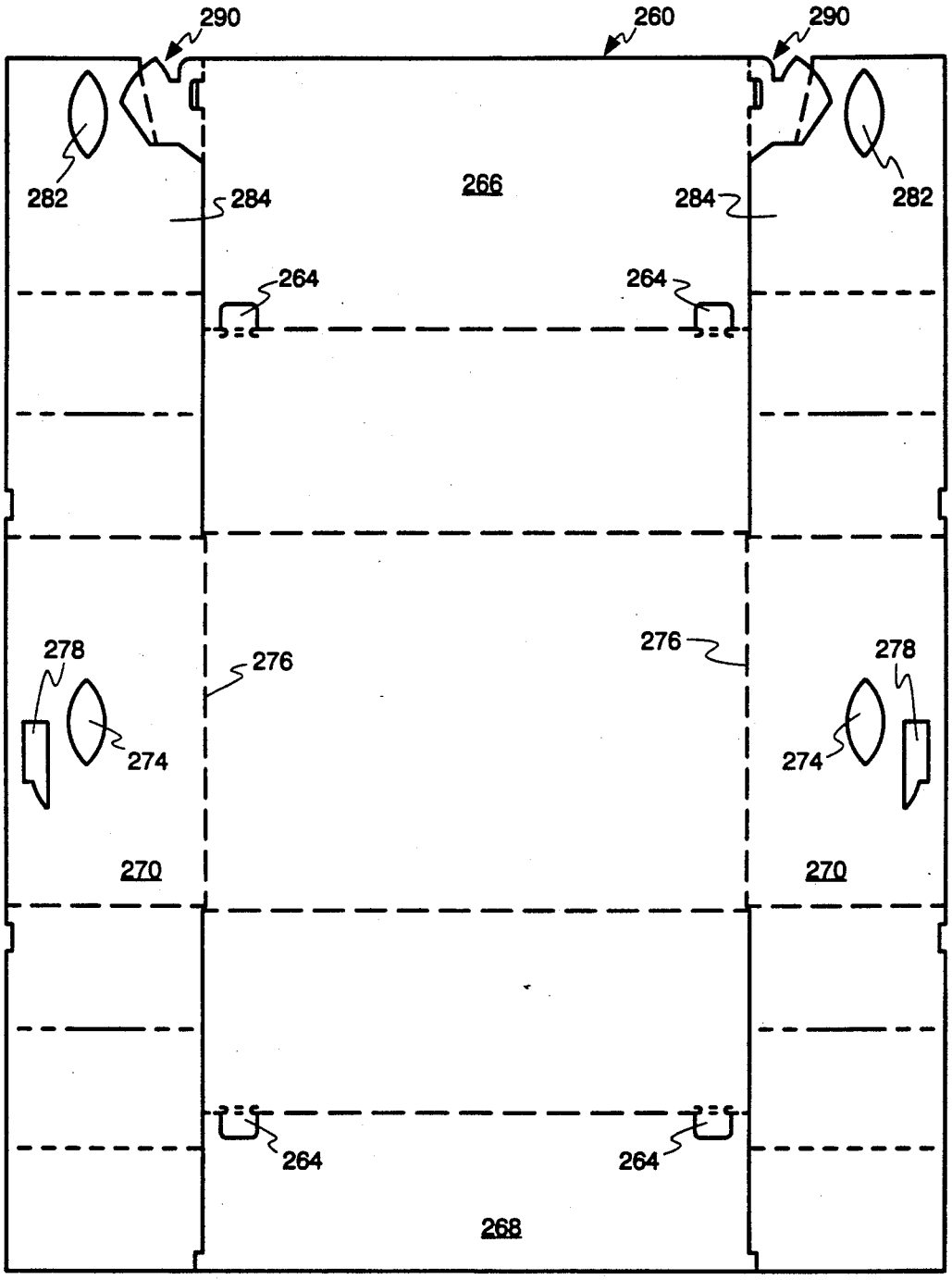
FIG. 22 is a plan view of a further embodiment of a carton blank illustrating aspects of the present invention.
Figure 23:
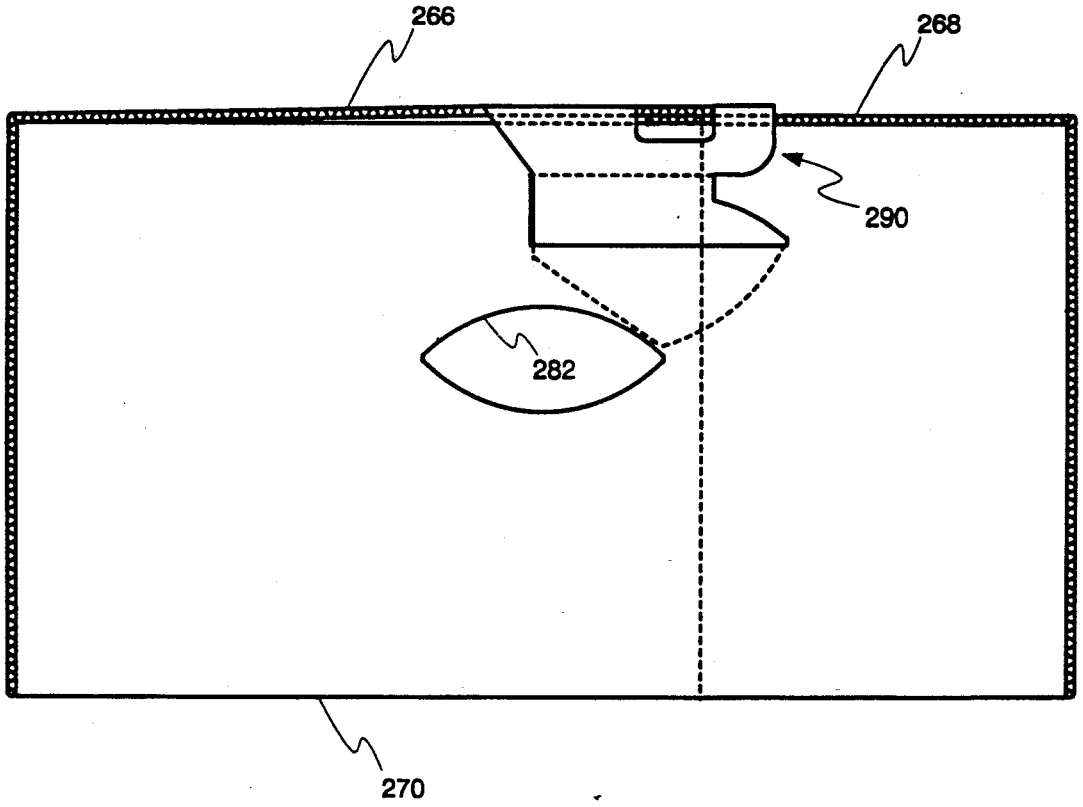
FIG. 23 is a side elevational view of a carton constructed from the blank of FIG. 22.

Turning now to FIGS. 22, 23, an alternative embodiment of a carton illustrating aspects of the present invention is shown. A carton blank 260 has features similar to those of blank 180, with a few notable exceptions. For example, the locking tabs 264 are struck out of the lid panels 266, 268 and the side panels 270 have hand holes 274 located closer to the connecting hinge line 276 than locking slots 278. As a result, the locking slots are located above the hand holes in the finished carton, as can be seen in FIG. 23. Also, although only one locking flap is provided for each sidewall of the carton, hand holes 282 are formed in reinforcing panels 284 and are separate from the locking flaps 290.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A carton having reinforced corners of multiple thickness, formed from a one-piece blank, comprising:

a floor panel having two pairs of opposed sides;

a pair of opposed endwall panels hingedly connected to one pair of said opposed sides of said floor panel, the endwall panels each having opposed sides;

lid panels in serial succession with each of said endwall panels and hingedly connected to respective ones of said endwall panels along respective hinge lines;

a pair of sidewall panels hingedly connected to the remaining pair of said opposed sides of said floor panel, said sidewall panels each having a pair of opposed sides;

a reinforcing panel subassembly coupled to each side of said sidewall panels, with pairs of said reinforcing panel subassemblies overlain by a respective one of said sidewall panels, each of said reinforcing panel subassemblies comprising first, second and third hingedly connected reinforcing panels;

the first, second and third reinforcing panels arranged end-to-end in a series within each of the reinforcing panel subassemblies, with the first panel of each of said subassemblies hingedly connected to one of said sides of a respective one of said sidewall panels, the first and second panels of each of said reinforcing panel subassemblies folded over one another so as to overlap one of said endwall panels and so as to position the third panel of respective ones of said reinforcing panel subassemblies to overlap one of said sidewall panels; and locking tabs extending from the endwall panels and folded between the first and second reinforcing panels to maintain the first, second and third reinforcing panels in position during assembly of the carton.

2. The carton of claim 1 wherein the first reinforcing panel of each reinforcing panel subassembly is notched to receive at least a portion of one of said locking tabs.

3. The carton of claim 1 wherein the third reinforcing panels, of reinforcing panel subassemblies which extend from a common one of said sidwalls, are dimensioned to butt against one another to further maintain the first, second and third reinforcing panels in position during assembly of the carton.

4. The carton of claim 1 wherein said locking tabs are located immediately adjacent said sidewalls to as to support opposed lateral edges of said endwalls.

5. The carton of claim 1 wherein the locking tabs are cut out mostly from the lid panels and, to a lesser extent, from the endwalls so as to extend from the endwalls with a hinged connection thereto.

6. The carton of claim 1 wherein the locking tabs are cut out from the endwalls so as to extend from the endwalls with a hinged connection thereto.

7. A carton having reinforced corners of multiple thickness, formed from a one-piece blank, comprising:

a floor panel having two pairs of opposed sides;

a pair of opposed endwall panels hingedly connected to one pair of said opposed sides of said floor panels, the endwall panels each having opposed sides;

lid panels in serial succession with each of said endwall panels and hingedly connected to respective ones of said endwall panels along respective hinge lines;

a pair of sidewall panels hingedly connected to the remaining pair of said opposed sides of said floor panel, the sidewall panels extending between said opposed endwall panels with each said sidewall panel defining at least one locking slot, said at least one locking slot having a first end of preselected height extending toward one of said endwall panels and a second end of reduced height which second end extends toward the other of said endwall panels and which second end forms an acute angle portion pointing toward the other of said endwall panels, the locking slot defining a generally rectangular opening with the acute angle portion extending from one side of the rectangular opening; and locking flaps extending from at least one of said lid panels, each locking flap having free ends forming locking ears for telescopic insertion through said locking slots and each having a connecting portion joining respective ones of the locking ears to respective ones of the lip panels so that said locking ears protrude beyond the connecting portions to which they are connected, toward the other one of said endwall panels.

8. The carton of claim 7 wherein the acute angle portion is partly formed by a concavely curved edge formed in said sidewall.

9. The carton of claim 8 wherein said locking ears each include a convexly curved edge portion which abuts the concavely curved edge of a respective locking slot when the locking ears are inserted in respective ones of said locking slots.

10. The carton of claim 9 wherein the convexly curved edge portions are located at the free ends of the locking flaps.

11. The carton of claim 9 wherein the locking ears include a fold line for bending the free ends toward each other during insertion into the locking slots.

* * * * *

UNITED STATES PATENT AND TRADEMARK OFFICE

CERTIFICATE OF CORRECTION

PATENT NO. : 5,289,970

DATED : March 1, 1994

INVENTOR(S) : McClure

It is certified that error appears in the above-indentified patent and that said Letters Patent is hereby corrected as shown below:

Claim 3, Column 8, line 45, change "sidwalls" to --sidewalls--.

Claim 4, Column 8, line 50, change "to as to" to --so as to--.

Signed and Sealed this

Nineteenth Day of July, 1994

*Attest:*

*Attesting Officer*

BRUCE LEHMAN

*Commissioner of Patents and Trademarks*